US011364507B2

(12) United States Patent
Convery

(10) Patent No.: US 11,364,507 B2
(45) Date of Patent: Jun. 21, 2022

(54) METHOD AND APPARATUS FOR GRADING AND WASHING SAND

(71) Applicant: CDE Global Limited, Cookstown (GB)

(72) Inventor: Anthony Convery, Moneymore (GB)

(73) Assignee: CDE Global Limited, Cookstown (GB)

( * ) Notice: Subject to any disclaimer, the term of this patent is extended or adjusted under 35 U.S.C. 154(b) by 7 days.

(21) Appl. No.: 17/041,741

(22) PCT Filed: Mar. 22, 2019

(86) PCT No.: PCT/EP2019/057311
§ 371 (c)(1),
(2) Date: Sep. 25, 2020

(87) PCT Pub. No.: WO2019/185489
PCT Pub. Date: Oct. 3, 2019

(65) Prior Publication Data

US 2021/0094044 A1 Apr. 1, 2021

(30) Foreign Application Priority Data

Mar. 26, 2018 (GB) ..... 1804797

(51) Int. Cl.
*B03B 5/34* (2006.01)
*B03B 9/00* (2006.01)
*B03B 5/04* (2006.01)

(52) U.S. Cl.
CPC ..... *B03B 9/00* (2013.01); *B03B 5/04* (2013.01); *B03B 5/34* (2013.01)

(58) Field of Classification Search
CPC .. B03B 5/04; B03B 5/34; B03B 5/623; B03B 7/00; B03B 9/02; B07B 2230/01
See application file for complete search history.

(56) References Cited

U.S. PATENT DOCUMENTS 9,744,537 B2 * 8/2017 Convery ..... B03B 9/00
10,272,443 B2 * 4/2019 Ivanoff ..... B03B 9/00
(Continued)

FOREIGN PATENT DOCUMENTS

EP 3006112 4/2016
GB 864954 4/1961
(Continued)

OTHER PUBLICATIONS

International Search Report of corresponding PCT Application No. PCT/EP2019/057311, dated Jul. 11, 2019.
(Continued)

*Primary Examiner* — Joseph C Rodriguez
(74) *Attorney, Agent, or Firm* — Gardner Linn

(57) ABSTRACT

A method of grading and washing sand including the steps of removing oversize material from a feed material to which water is added on a first grading screen, whereby the oversize material passes over a downstream end of an apertured deck of the first grading screen, undersize material and water passing through the apertured deck being collected in a sump of the first grading screen before being passed onto an apertured deck of a second grading screen having apertures of a smaller size than those of the deck of the first grading screen, oversize material passing over a downstream end of the second grading screen, pumping water and undersize material from a sump of the second grading screen to a washing stage to remove fine contaminants therefrom.

17 Claims, 5 Drawing Sheets

(56) References Cited

U.S. PATENT DOCUMENTS

| | | | | |
|---|---|---|---|---|
| 11,103,879 | B2 * | 8/2021 | Ivanoff | B03B 11/00 |
| 2010/0193618 | A1 | 8/2010 | Lewis-Gray | |
| 2016/0101428 | A1 * | 4/2016 | Convery | B03B 5/48 209/3 |

FOREIGN PATENT DOCUMENTS

| | | |
|---|---|---|
| GB | 2503812 | 1/2014 |
| GB | 2505483 | 3/2014 |
| GB | 2524651 | 9/2015 |
| GB | 2546491 | 7/2017 |
| GB | 2552042 | 1/2018 |
| GB | 2560038 | 8/2018 |
| JP | H08103800 | 4/1996 |
| JP | 2007144390 | 6/2007 |
| RO | 114566 | 6/1999 |
| WO | 2009090294 | 7/2009 |

OTHER PUBLICATIONS

UK Search Report of corresponding Application No. GB1804797.7, dated Sep. 24, 2018.

* cited by examiner

METHOD AND APPARATUS FOR GRADING AND WASHING SAND

CROSS REFERENCE TO RELATED APPLICATIONS

The present application is a § 371 national stage of International Application PCT/EP2019/057311, filed Mar. 22, 2019, which claims priority benefit to U.K. Pat. Application Ser. No. 1804797.7, filed Mar. 26, 2018, both of which are hereby incorporated herein by reference in their entireties.

FIELD OF THE INVENTION

This invention relates to a method and apparatus for grading and washing sand and, in particular, to a method and apparatus for grading and washing sand in a particularly compact and efficient manner.

BACKGROUND OF THE INVENTION

Aggregate is a broad category of coarse particulate material used in construction, including sand, gravel and crushed stone. Aggregates are the most mined materials in the world. The term "sand" typically covers aggregate having a grain sand of between 0.075 mm and 4.75 mm while the term "gravel" typically covers aggregate having a grain size of between 4.75 mm and 76.2 mm. Aggregates are typically washed and graded on a combination of vibrating screens and hydrocyclones to produce washed aggregate products having a predetermined grain size or range of grain size.

A typical vibrating screen includes a frame, defined by a pair of substantially parallel side walls interconnected by transversely extending bridging members, upon which is mounted a polyurethane deck having small openings or slots for water and undersize particles to pass through. The frame is typically mounted on a base via resilient linkages and the frame, and thus the deck, is typically vibrated by means of a pair of counter rotating rotors defining eccentric masses, driven by one or more drive motors, to impart circular or reciprocating vibrating motion to the deck. Such screens can be used for grading and/or dewatering aggregate, oversize material passing over the deck of the screen to be collected from a downstream end of the screen while water and undersize material is collected in a sump of the screen for subsequent processing.

A hydrocyclone is a device used to separate particles in a liquid suspension based on the ratio of their centripetal force to fluid resistance. This ratio is high for coarse particles and low for fine particles. A hydrocyclone typically includes a cylindrical section having an inlet for supplying a feed slurry into the hydrocyclone tangentially, and a conical base. Outlets are provided at upper and lower ends of the hydrocyclone. Underflow, containing the coarser fraction, passes out of the lower outlet while overflow, containing the finer fraction and most of the water, passes out of the outlet at the upper end of the hydrocyclone.

Most aggregate grading and washing plants are very large, including different stages including multiple grading and dewatering screens and hydrocyclones, and typically require a large volume of water to fluidise the material in each stage of the process and to transfer the material between different stages of the process and multiple pumps for transferring fluidised material and water between different stages of the apparatus and multiple conveyors for transferring waste material and/or sand or aggregate products to stockpiles.

Such plants require considerable installation time and are not readily moveable once installed on a site.

SUMMARY OF THE INVENTION

The present invention provides a particularly compact, portable and adaptable apparatus and method of operation thereof, which can produce at least one washed sand product of a highly specific range of grain size, such as for use as frac sand or glass sand, and which is readily moveable between sites.

According to a first aspect of the present invention there is provided a method of grading and washing sand including the steps of removing oversize material from a feed material to which water is added on a first grading screen, whereby the oversize material passes over a downstream end of an apertured deck of the first grading screen, undersize material and water passing through the apertured deck being collected in a sump of the first grading screen before being passed onto an apertured deck of a second grading screen having apertures of a smaller size than those of the deck of the first grading screen, oversize material passing over a downstream end of the second grading screen, pumping water and undersize material from a sump of the second grading screen to a washing stage to remove fine contaminants therefrom.

In one embodiment the washing stage may include the steps of passing water and undersize material from a sump of the second grading screen to one or more hydrocyclones thereby washing and removing fine contaminants therefrom before dewatering the underflow from the one or more hydrocyclones on a deck of a dewatering screen before collecting the resulting dewatered material as a sand product. In an alternative embodiment the washing stage may include the steps of passing water and undersize material from a sump of the second grading screen to a counter flow classification unit via a first hydrocyclone, passing the underflow from the counter flow classification unit onto the deck of a first dewatering screen, passing undersize material and water from a sump of the first dewatering screen to a second hydrocyclone and passing the underflow from the second hydrocyclone onto the deck of the first dewatering screen before collecting the resulting dewatered oversize material from the deck of the first dewatering screen as a first sand product. The washing stage may further include the steps of passing an overflow from the counter flow classification unit to the sump of a second dewatering screen and pumping material and water from the sump of the second dewatering screen to a further hydrocyclone, passing the underflow from the further hydrocyclone onto the deck of the second dewatering screen before collecting the resulting dewatered oversize material from the deck of the second dewatering screen as a second sand product.

The method may further include the step of passing oversize material from both the first and second grading screens onto a common conveyor. Alternatively the method may comprise the step of passing oversize material from both the first and second grading screens onto separate conveyors.

According to a further aspect of the present invention there is provided an apparatus for grading and washing sand including a chassis, a first grading screen mounted on the chassis for removing oversize material from a feed material, the first grading screen including an apertured deck, a water outlet or other means for supplying water onto material on the deck, and a sump thereunder for receiving undersize material and water passing through the deck, oversize material passing over a downstream end of the deck, a second grading screen mounted on the chassis having an apertured deck, the apertures being smaller in size than the apertures of the deck of the first grading screen, a water outlet or other means for supplying water onto material on the deck and a sump thereunder for receiving undersize material and water passing through the deck oversize material passing over a downstream end of the deck, the undersize material collected in the sump of the second grading screen being passed to a washing stage before being collected as a sand product In one embodiment the first and second grading screens may be located adjacent one another such that oversize material passing over the downstream end of the decks of the first and second grading screens is passed onto a common conveyor. The common conveyor may extend transversely from the chassis between the first and second grading screens.

In an alternative embodiment oversize material passing over the downstream end of the decks of the first and second grading screens may be passed onto respective first and second conveyors. The first and second conveyors may extend transversely from either side of the chassis, between the first and second grading screens.

The second grading screen may include a combined grading and dewatering screen having an upstream section inclined downwardly from a first end to second end for grading sand thereon and a downstream section for dewatering material thereon, wherein the upstream section of the deck is inclined downwardly at a first angle to the horizontal with respect to the normal direction of travel of material on the deck and the downstream section being arranged substantially horizontally or inclined upwardly at a second angle to the horizontal with respect to the normal direction of travel of material on the deck wherein, in use, material and water may be delivered onto the deck at or adjacent the first end of the upstream section, undersized material passing through the apertures in the upstream section while oversized material is conveyed over the upstream section of the deck under the action gravity before passing onto the downstream section of the deck, whereby the oversized particles are dewatered.

A first pump may be provided for pumping material (entrained in water) from the sump of the first grading screen to the deck of the second grading screen.

In one embodiment the washing stage may include one or more hydrocyclones receiving undersize material and water from the sump of the second grading screen, an underflow from the one or more hydrocyclones being delivered onto a dewatering screen over which the one or more hydrocyclones are mounted. A second pump may be provided for pumping material (entrained in water) from the sump of the second screen to the one or more hydrocyclones. A further hydrocyclone may be mounted above the dewatering screen, the further hydrocyclone receiving material (entrained in water) from the sump of the dewatering screen and delivering and underflow from the further hydrocyclone onto the deck of the dewatering screen. At least a portion of an overflow from the one or more hydrocyclones, and further hydrocyclone when provided, may be delivered to the sumps of the first and second grading screens and/or to material on or upstream of the deck of the first and/or second grading screens.

In an alternative embodiment the washing stage may include a counter flow classification unit receiving undersize material and water from the sump of the second grading screen via a first hydrocyclone, the underflow from the counter flow classification unit passing onto the deck of a first dewatering screen, undersize material and water being passed from a sump of the first dewatering screen to a second hydrocyclone, the underflow from the second hydrocyclone being received by the deck of the first dewatering screen, the resulting dewatered oversize material from the deck of the first dewatering screen being collected as a first sand product.

A second dewatering screen may be provided having a deck and a sump therebeneath, the overflow of the counter flow classification unit being received by the sump of the second dewatering screen, material and water from the sump of the second dewatering screen being pumped to a further hydrocyclone, the underflow from the further hydrocyclone passing onto the deck of the second dewatering screen, the resulting dewatered oversize material from the deck of the second dewatering screen being collected as a second sand product.

A feed box may be provided extending across the width of the second grading screen for delivering material and water onto the deck of the second grading screen to control the flow of the material onto the second grading screen.

Each of the first and second grading screens may include a frame mounted upon the chassis via a resilient mount or mounting means and upon which is mounted a screening surface having a plurality of apertures therein for grading and dewatering aggregate, the frame being provided with vibration generator or generating means for imparting vibration to the frame, and sump beneath the screening surface for receiving water and undersize material therefrom.

The or each of the first, second and further hydrocyclones may comprise two or more cyclones arranged in parallel.

These and other objects, advantages and features of the invention will become apparent upon review of the following specification in conjunction with the drawings.

BRIEF DESCRIPTION OF THE DRAWINGS

A method and apparatus for grading and washing sand in accordance with an embodiment of the present invention will now be described, with reference to the accompanying drawings, in which.

DETAILED DESCRIPTION OF THE DRAWINGS

Figure 1:
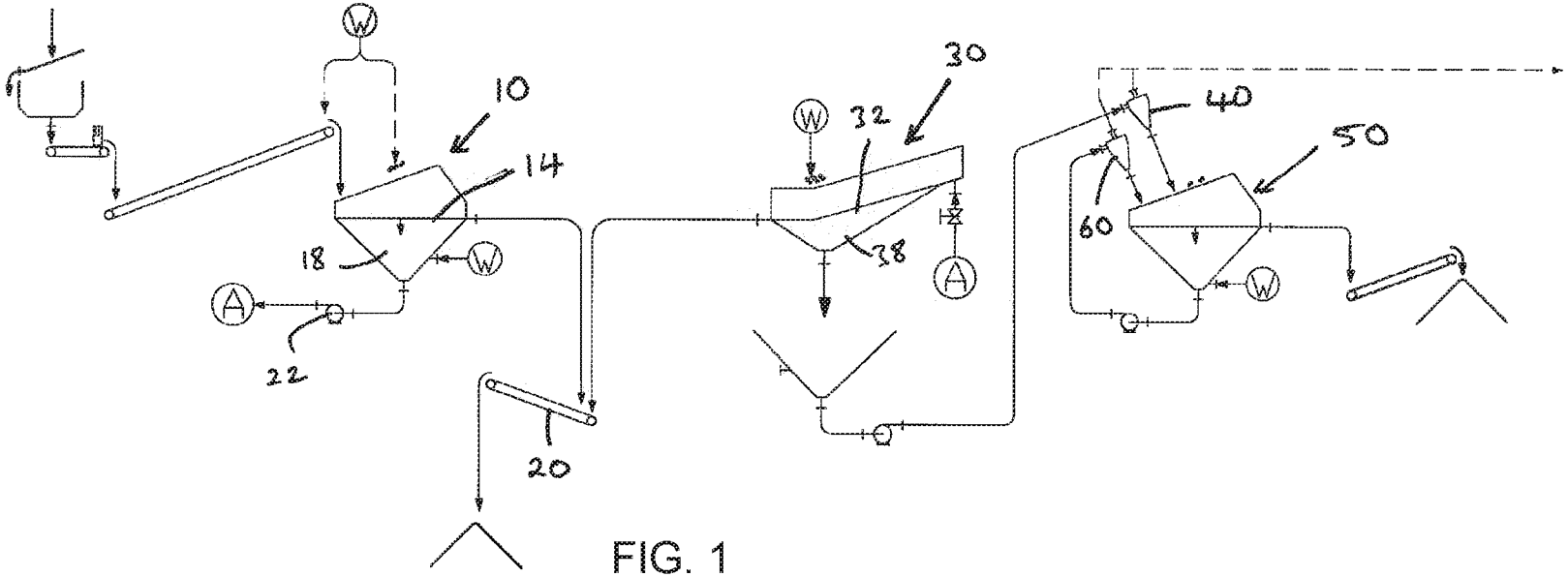
—FIG. 1 is a schematic flow chart of a method of grading and washing sand in accordance with an embodiment of the present invention.
Figure 2:
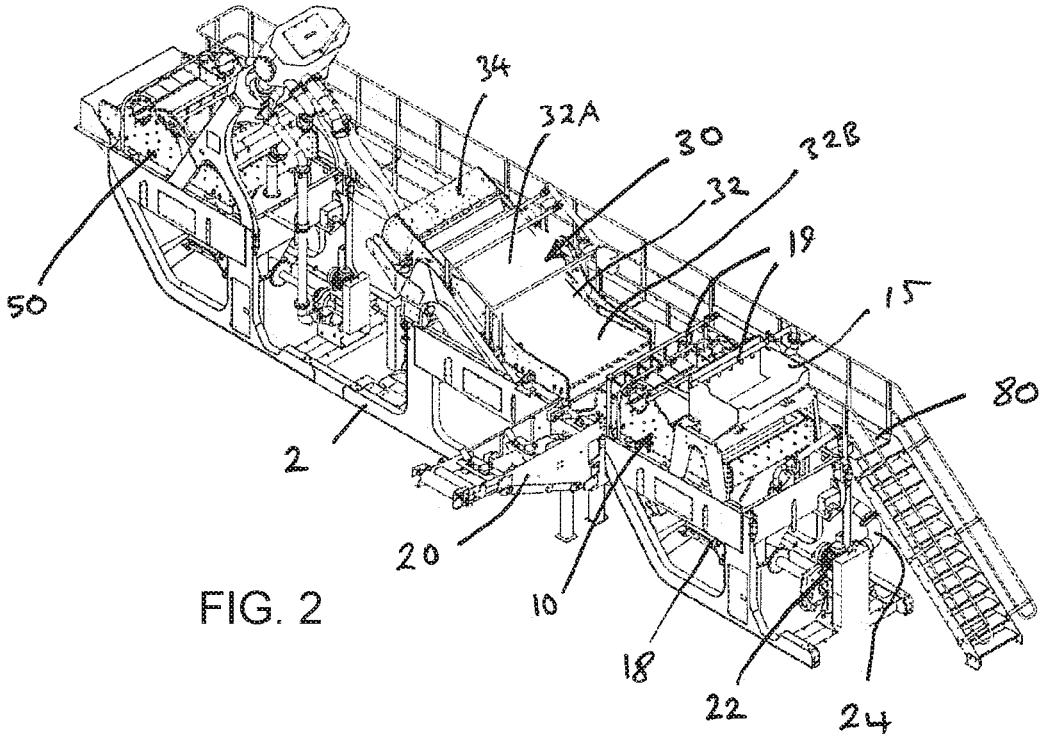
FIG. 2 is a perspective view of an apparatus for grading and washing sand in accordance with an embodiment of the present invention.
Figure 3:
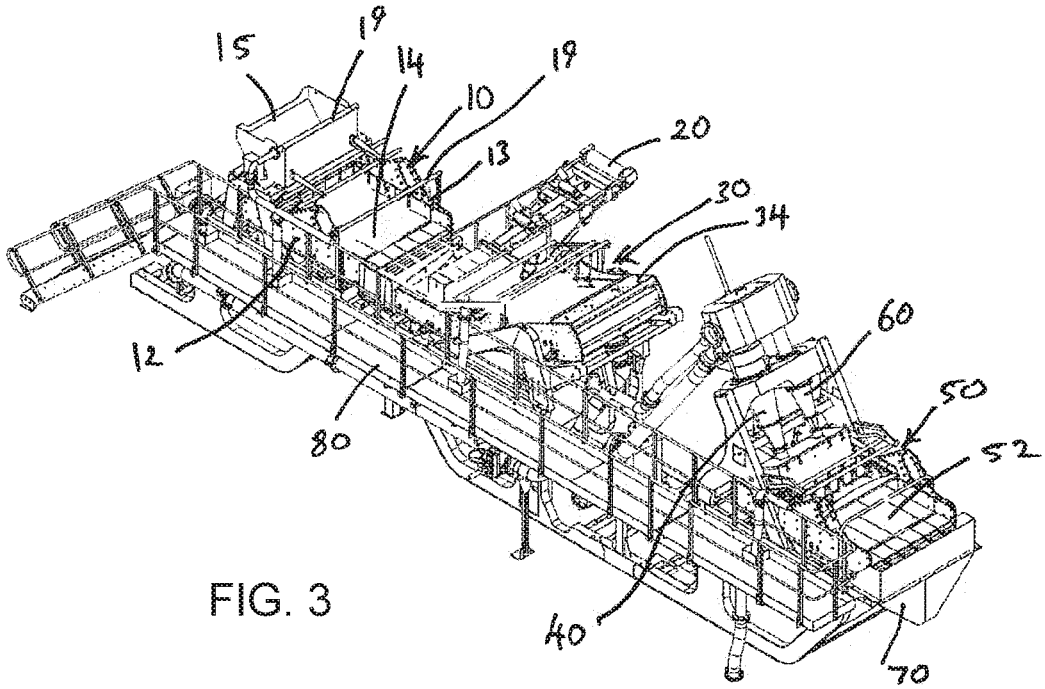
FIG. 3 is another perspective view of the apparatus of FIG. 2.
Figure 4:
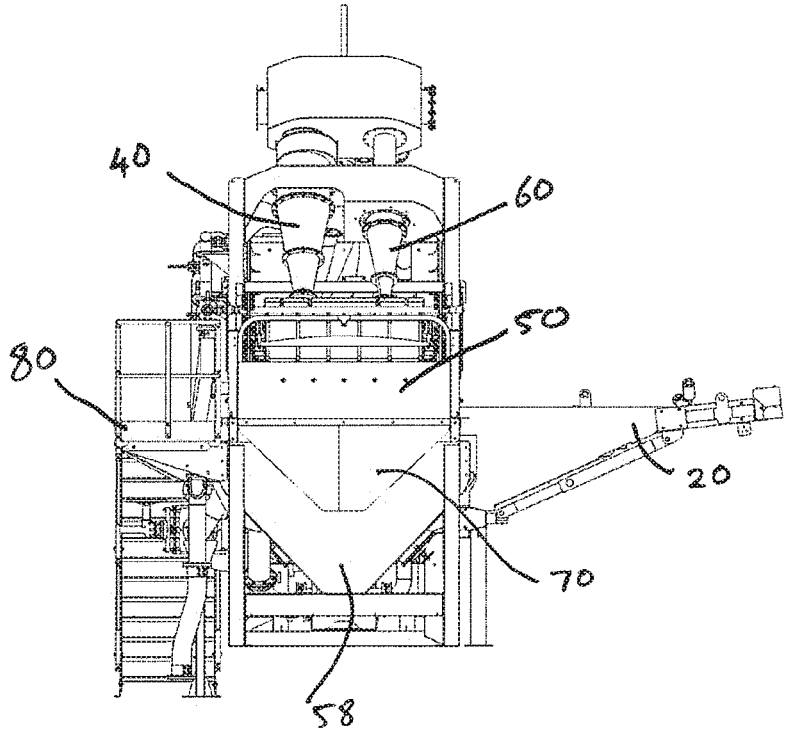
FIG. 4 is an end view of the apparatus of FIG. 2.
Figure 5:
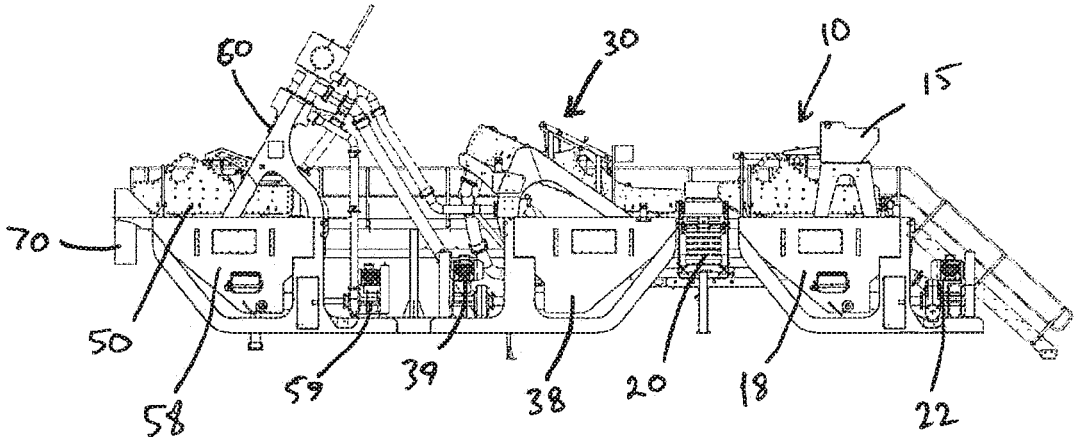
FIG. 5 is a side view of the apparatus of FIG. 2.
Figure 6:
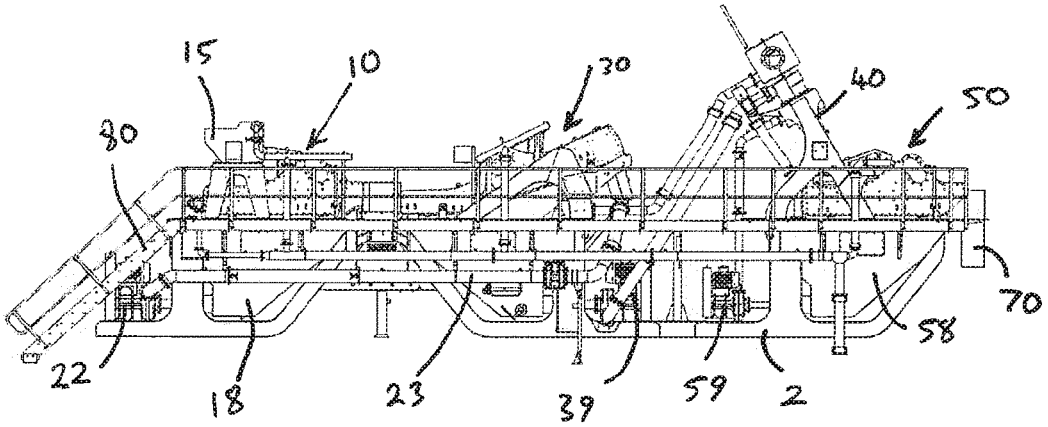
FIG. 6 is a further side view of the apparatus of FIG. 2.

A method of grading and washing sand in accordance with an embodiment of the present invention is illustrated in FIG. 1.

The method includes a first grading stage, wherein oversize material and trash is removed from a feed material to which water is added on a first grading screen 10, oversize material passing over a downstream end of an apertured deck of the first grading screen while undersize material and water passes through the apertured deck to be collected in a sump of the first grading screen 10 before being passed onto an apertured deck of a second grading screen 30 in a second grading stage, the second grading screen 30 having apertures of a smaller size than those of the deck of the first grading screen, oversize material passing over a downstream end of the second grading screen 30. Water and undersize material is pumped from a sump of the second grading screen 30 to one or more hydrocyclones 40 thereby washing and removing fine contaminants therefrom the underflow from the one or more hydrocyclones is dewatered on a deck of a dewatering screen 50 before collecting the resulting dewatered material as a sand product.

The second grading stage may be carried out on a combined grading and dewatering screen 20.

In the embodiment shown in FIG. 1 the first and second grading screens 10,30 are mounted adjacent one another with their discharge ends facing one another such that oversize material from the first and second grading screens 10,30 is delivered onto a common conveyor 20. Alternatively the oversize material from the first and second grading screens may be passed onto respective separate screens for stockpiling, possibly as one or two separate further products.

In the embodiment shown in FIG. 1, the underflow from the second grading screen is passed to a further hydrocyclone 60 to remove further fine contamination, the underflow from the further hydrocyclone being delivered onto the deck of the second grading screen.

The overflow from the first and second hydrocyclones is recycled and supplied to material on the first and second screens and/or into the sumps of the first and second screens to control the water content thereof.

An apparatus for grading and washing aggregate in accordance with an embodiment of the present invention is illustrated in the drawings.

The apparatus includes an elongate chassis 2 including spaced apart elongate chassis members linked by transverse bridging members. Preferably the chassis 2 is dimensioned to fit into a standard shipping container and/or onto a trailer for transportation.

A first vibratory grading screen 10 is mounted at a first end of the chassis 2 for receiving a feed material thereon, the first screen 10 being mounted on the chassis 2 via resilient mounts and being formed from a pair of side plates 12,13 having bridging members (hidden in the drawings) extending therebetween. A deck 14 including polyurethane mats having a plurality of slots or apertures formed therein is mounted between the side plates 12,13. The feed material may be transferred onto the first screen 10 via a feed hopper 15 and associated feed conveyor (not shown), as is conventional in the art.

A vibration generator or generating means 16 (shown in FIG. 7) is mounted between the side plates 12,13, extending transverse to the deck 14. The vibration generating means may include a pair of motor driven eccentrically loaded rotors mounted in a support tube mounted between the side plates 12,13 for rotation about substantially parallel rotational axes extending transverse to the deck 14.

Rotation of the rotor or rotors causes a rotating out of balance force to be applied to the screen 10, imparting a vibratory motion to the deck 14 and to the material carried thereon. Such vibratory motion causes material carried on the deck 14 to be agitated and fluidised, preventing blocking of the openings in the deck and causing oversize material on the deck 14 to be conveyed towards one end thereof while water and undersize material may pass through the deck 14 to be collected in a sump 18 beneath the deck 14 of the screen 10.

Each side wall 12,13 of the screen 10 may be made up of a laminated assembly of steel plates, preferably as disclosed in GB 2,505,483, incorporated herein by reference.

Spray bars 19 are mounted above the deck 14 and/or feed hopper 15 for adding water to the material thereon.

The deck 14 of the first screen 10 has relatively large apertures formed therein, wherein sand, fine contaminants and water can pass through the apertures in the deck 14 while gravel and any large contaminants pass over the deck 14 to be delivered onto a first conveyor 20 extending laterally from the chassis 2 to be delivered onto a stock pile as a first aggregate product or for later disposal. The first screen 10 may be adapted to remove +6 mm material from the feed material (in the case of frac sand) or +2 mm material (in the case of glass sand for glass production).

A pump 22 is associated with the sump 18 beneath the deck 14 of the first screen 10 for pumping water and undersize material through a delivery pipe 24 to the inlet end of a second screen 30, the second screen including a combined grading and dewatering screen, such as that disclosed in GB 2,524,651 incorporated herein by reference. The second screen 30 is similar in construction to the first screen 10, having a deck 32 including slotted or apertured mats mounted between a pair of side plates, the second screen 30 being resiliently mounted on the chassis 2 and having a vibration generator or generating means for imparting vibratory motion to the deck to agitate the material thereon. The deck 32 of the second screen 30 has smaller apertures than those of the first screen 10.

The deck 32 of the second screen 30 is divided into an upstream section 32A including a grading section, upon which material from the sump 18 of the first screen 10 is graded, undersize particles passing through the slots while oversized particles are retained on the deck, and a downstream section 32B including a dewatering section, upon which the sand, including the oversized particles, is dewatered. A common sump 38 receives water and undersize material passing through both the upstream grading section 32A and the downstream dewatering section 32B of the second screen 30.

A feed box 34 (such as that disclosed in GB 2,503,812) is provided at an upper end of the deck 32 of the second screen 30 to feed material from the sump 18 of the first screen onto the deck 32 of the second screen adjacent an upper end of the first or upstream section 32A thereof. The mixture passes out of the feed box 34 onto the deck via an elongate slot provided in a side of the feed box 34.

The upstream grading section 32A of the deck 32 is arranged to slope downwardly towards the downstream dewatering section 32B at an angle to the horizontal suited to the grading operation, while the downstream dewatering section 32B of the deck 32 is arranged at a shallow upward angle sloping upwardly towards a discharge end of the downstream dewatering section 32B to suit the dewatering operation.

The upstream grading section 32A may have a downward slop of approximately 25° while the downstream dewatering section 32B may have an upward slope of approximately 5°.

The second screen 30 is arranged adjacent the first screen 10, with the discharge ends of the first and second grading screens 10,30 facing one another, such that oversize material from the second screen 30 is delivered onto the first conveyor 20 along with oversize material from the first screen 10, the first conveyor being located between the first and second screens 10,30 and extending transversely from the chassis 2 to one side thereof, thereby providing a particularly compact arrangement.

A washing stage, including of a first hydrocyclone 40 and a dewatering screen 50, is mounted at a second end of the chassis 2, opposite the first end. The first hydrocyclone 40 washes and dewaters the sand from the sump 38 of the second screen 30, removing fine contaminants, such as silt and clay. Washed sand and some water passes out of the underflow of the first hydrocyclone 40 while water and fine contaminants pass out of the overflow thereof.

The first hydrocyclone 40 is mounted above the dewatering screen 50 such that the underflow from the first hydrocyclone 40 is delivered onto the deck 52 of the dewatering screen 50. Water and remaining fine contaminants passing through the deck 52 of the dewatering screen 50 and are collected in a sump 58 beneath the deck 52.

A further hydrocyclone 60 may be mounted above the dewatering screen 50, alongside the first hydrocyclone 40 for receiving slurry of sand and water from the sump 58 of the dewatering screen 50 via a pump 59 before delivering an underflow onto the deck 52 of the dewatering screen 50 to provide additional cleaning of the sand product, if required.

The provision of the second hydrocyclone 60 in addition to the first hydrocyclone 40 may provide a dual pass fines washing system, maximising the removal of unwanted fines, such as silt, from the sand product.

A collection hopper 70 may be mounted beneath a discharge end of the deck 42 of the dewatering screen 40 for receiving the sand product therefrom. The collection hopper 70 may be arranged to deliver the sand product onto a suitable conveyor (not shown).

At least a portion of the overflow from both the first and second hydrocyclones 30,60 may be passed into the sumps 18,38 of the first and second screens 10,30 and/or sump 58 of the dewatering screen 50 as required to maintain a sufficient water content in the material in the sumps 18,38,58 to allow efficient operation of the pumps 22,39,59. A remaining portion of the overflow from the hydrocyclones 30,60 may be passed onto the first and second screens 10,30 and/or dewatering screen 50 via the spray bars thereof once cleaned via a to a thickener tank or settling pond, wherein the silt and other fine contaminants may be removed to allow the water to be reused.

A detachable walkway 80 may be mounted on one side of the chassis 2 to facilitate maintenance and operation of the apparatus.

The dewatering screen 50 may be configurable as a split screen having a longitudinally extending dividing wall separating the grading screen into first and second screening regions. The underflow from the first hydrocyclone 40 may be configured to be delivered onto the first screening region of the dewatering screen 50 and at least a portion of the underflow from the second hydrocyclone 60 may be configured to be delivered onto the second screening region of the dewatering screen 50.

Figure 7:
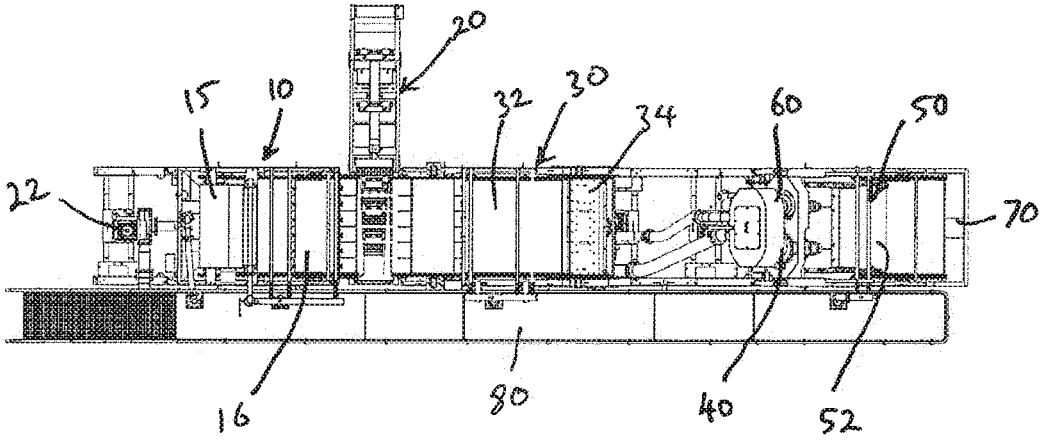
FIG. 7 is a plan view of the apparatus of FIG. 2.
Figure 8:
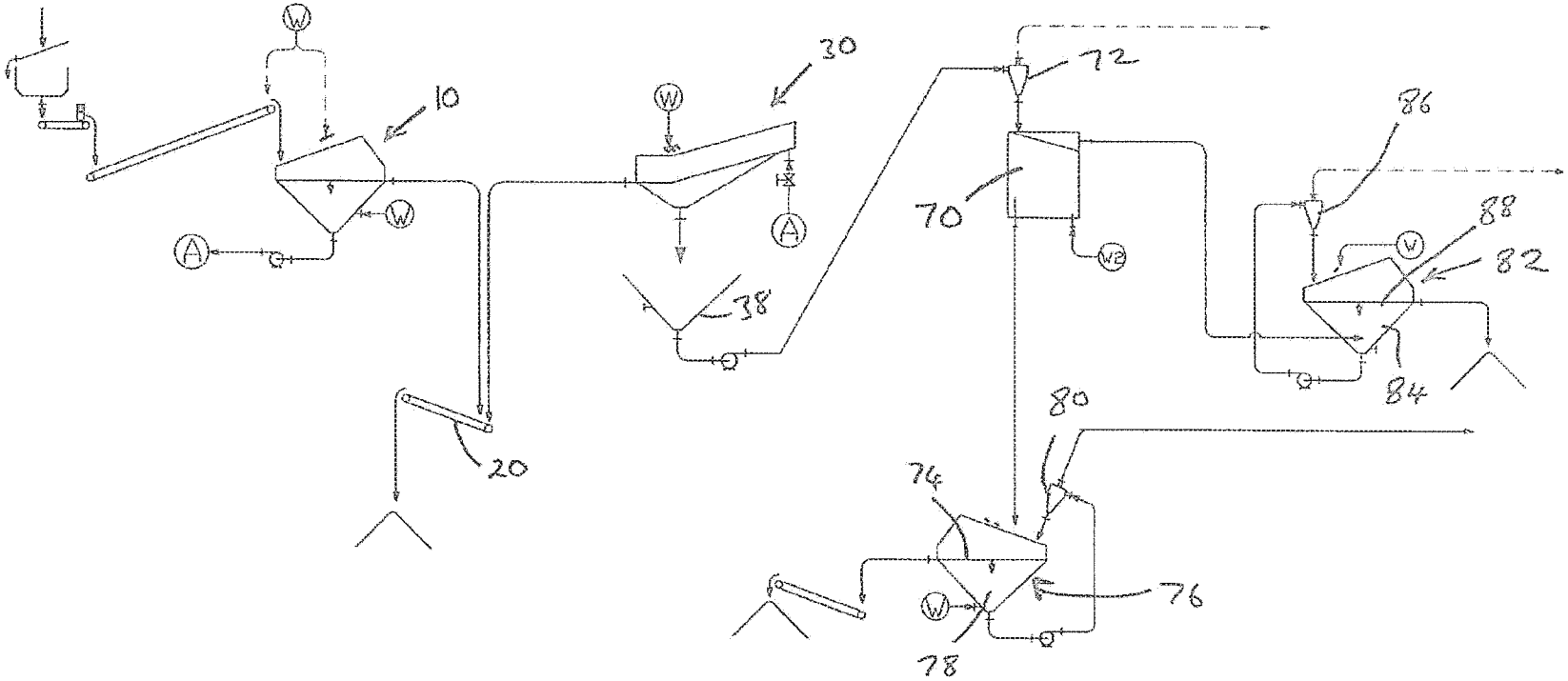
FIG. 8 is a schematic flow chart of a method of grading and washing sand in accordance with a further embodiment of the present invention.

In an alternative embodiment a further process, such as a classification process, may be provided upstream of the washing stage. For example, as illustrated in FIG. 7, a counter flow classification unit 70 may be located upstream of the washing stage for receiving material and water from the sump 38 of the second screen via the underflow of a further cyclone 72. Such classification process may be used to produce a further product and/or to remove high or low density contaminants from the sand product passed to the washing stage.

As shown in FIG. 7, the heavy material settling under gravity in the lower end of the counter flow classification unit 70 may be passed onto the deck 74 of a dewatering screen 76, water and undersize material collected in the sump 78 of the screen 76 being pumped into a hydrocyclone before the underflow passes back onto the deck 74 of the screen 76 before the dewatered oversize material from the deck 74 of the screen 76 passes to a stockpile as a first sand product. The overflow from the counter flow classification unit 70 may be passed to the sump 84 of a further dewatering screen 82 before being passed to a further hydrocyclone 86, the underflow from the hydrocyclone 86 passing onto the deck 88 of the screen 82, the dewatered oversize material from the deck 88 of the screen 82 being collected as a further product.

The invention is not limited to the embodiment described herein but can be amended or modified without departing from the scope of the present invention, which is intended to be limited only by the scope of the appended claims as interpreted according to the principles of patent law including the doctrine of equivalents.

The invention claimed is:

1. A method of grading and washing sand comprising:
- removing oversize material from a feed material to which water is added on a first grading screen;
- passing the oversize material over a downstream end of an apertured deck of the first grading screen;
- collecting undersize material and water that passes through the apertured deck in a sump of the first grading screen;
- passing the undersize material from the sump onto an apertured deck of a second grading screen adjacent the first grading screen and having apertures of a smaller size than those of the deck of the first grading screen;
- passing oversize material from the deck of the second grading screen over a downstream end of the second grading screen;
- passing the oversize materials from both of the adjacent first and second grading screens onto (1) a common conveyor or (2) separate conveyors; and
- pumping water and undersize material from a sump of the second grading screen to a washing stage to remove fine contaminants therefrom, the washing stage comprising:
  - passing water and undersize material from the sump of the second grading screen to a counter flow classification unit via a first hydrocyclone;
  - passing an underflow from the counter flow classification unit onto a deck of a first dewatering screen;
  - passing undersize material and water from a sump of the first dewatering screen to a second hydrocyclone;
  - passing an underflow from the second hydrocyclone onto the deck of the first dewatering screen; and
  - collecting a resulting dewatered oversize material from the deck of the first dewatering screen as a first sand product.

2. A method as claimed in claim 1, further comprising:
- passing an overflow from the counter flow classification unit to a sump of a second dewatering screen;
- pumping material and water from the sump of the second dewatering screen to a further hydrocyclone;
- passing an underflow from the further hydrocyclone onto a deck of the second dewatering screen; and
- collecting a resulting dewatered oversize material from the deck of the second dewatering screen as a second sand product.

3. A method as claimed in claim 1, wherein said passing the oversize materials from both of the adjacent first and second grading screens comprises passing the oversize materials from both the first and second grading screens onto the common conveyor.

4. A method as claimed in claim 1, wherein said passing the oversize materials from both of the adjacent first and second grading screens comprises passing the oversize materials from both the first and second grading screens onto the separate conveyors.

5. An apparatus for grading and washing sand, said apparatus comprising:

a chassis;

a first grading screen mounted on the chassis for removing oversize material from a feed material, the first grading screen comprising:

a first apertured deck;

a first water outlet adapted to supply water onto material on the first deck; and a first sump under the first grading screen for receiving undersize material and water passing through the first deck, wherein oversize material passes over a downstream end of the first deck;

a second grading screen mounted on the chassis and comprising:

a second apertured deck, wherein apertures of the second deck are smaller in size than apertures of the first deck;

a second water outlet adapted to supply water onto material on the second deck; and a second sump under the second grading screen for receiving undersize material and water passing through the second deck, wherein oversize material passes over a downstream end of the second deck and the undersize material that is collected in the second sump is passed to a washing stage before being collected as a first sand product; and either of:

(1) a common conveyor, wherein the first and second grading screens are located adjacent one another such that oversize materials passing over the downstream ends of the first and second decks are passed onto the common conveyor; or (2) first and second conveyors, wherein the first and second grading screens are located adjacent one another such that oversize materials passing over the downstream ends of the first and second decks are passed onto the first and second conveyors, respectively;

wherein the washing stage comprises a counter flow classification unit receiving undersize material and water from the second sump via a first hydrocyclone, an underflow from the counter flow classification unit passing onto a deck of a first dewatering screen, undersize material and water being passed from a sump of the first dewatering screen to a second hydrocyclone, an underflow from the second hydrocyclone being received by the deck of the first dewatering screen, wherein resulting dewatered oversize material from the deck of the first dewatering screen is collected as the first sand product.

6. An apparatus as claimed in claim 5, comprising the common conveyor.

7. An apparatus as claimed in claim 6, wherein the common conveyor extends transversely from the chassis between the first and second grading screens.

8. An apparatus as claimed in claim 5, comprising the first and second conveyors.

9. An apparatus as claimed in claim 8, wherein the first and second conveyors extend transversely from either side of the chassis, between the first and second grading screens.

10. An apparatus as claimed in claim 5, wherein:

the second grading screen comprises a combined grading and dewatering screen having an upstream section inclined downwardly from a first end to second end for grading sand thereon, and a downstream section for dewatering material thereon;

wherein the upstream section of the second deck is inclined downwardly at a first angle to the horizontal with respect to the normal direction of travel of material on the second deck and the downstream section being arranged substantially horizontally or inclined upwardly at a second angle to the horizontal with respect to the normal direction of travel of material on the second deck;

wherein when material and water are delivered onto the second deck at or adjacent the first end of the upstream section, undersized material passes through the apertures in the upstream section while oversized material is conveyed over the upstream section of the second deck under the action gravity before passing onto the downstream section of the second deck so that oversized particles of the oversized material are dewatered.

11. An apparatus as claimed in claim 5, wherein a first pump is provided for pumping material, entrained in water, from the first sump to the second deck.

12. An apparatus as claimed in claim 11, wherein a second pump is provided for pumping material, entrained in water, from the second sump to the first and second hydrocyclones.

13. An apparatus as claimed in claim 5, wherein a further hydrocyclone is mounted above the first dewatering screen, the further hydrocyclone receiving material, entrained in water, from a sump of the first dewatering screen and delivering an underflow from the further hydrocyclone onto a deck of the first dewatering screen.

14. An apparatus as claimed in claim 13, wherein at least a portion of an overflow from the first and second hydrocyclones, and from the further hydrocyclone, is delivered to one or more of the first and second sumps, and to material on or upstream of one or both of the first and second decks.

15. An apparatus as claimed in claim 5, further comprising a second dewatering screen having a deck and a sump therebeneath, an overflow of the counter flow classification unit being received by the sump of the second dewatering screen, wherein material and water from the sump of the second dewatering screen is pumped by a pump to a further hydrocyclone, an underflow from the further hydrocyclone passing onto the deck of the second dewatering screen, wherein a resulting dewatered oversize material from the deck of the second dewatering screen is collected as a second sand product.

16. An apparatus as claimed in claim 5, further comprising a feed box extending across the width of the second grading screen for delivering material and water onto the deck of the second grading screen to control the flow of the material onto the second grading screen.

17. An apparatus as claimed in claim 5, wherein each of the first and second grading screens comprises a frame mounted upon the chassis via a resilient mount upon which is mounted a screening surface having a plurality of apertures therein for grading and dewatering aggregate, the frame being provided with a vibration generator for imparting vibration to the frame, and a sump beneath the screening surface for receiving water and undersize material therefrom.

* * * * *